US005356104A

United States Patent [19]

Rosenberg et al.

[11] Patent Number: 5,356,104

[45] Date of Patent: Oct. 18, 1994

[54] MOUNTING BRACKET ASSEMBLY FOR USE IN A SLATWALL CONSTRUCTION

[75] Inventors: Leonard Rosenberg, Highland Park; Frank Dimattia, Cedar Grove, both of N.J.

[73] Assignee: Gould Metal Specialities, Inc., Union, N.J.

[21] Appl. No.: 129,999

[22] Filed: Sep. 30, 1993

[51] Int. Cl.[5] ..... A47B 96/06

[52] U.S. Cl. ..... 248/220.2; 248/225.1

[58] Field of Search ..... 248/220.2, 225.1, 223.3, 248/231.8, 247, 248, 249; 211/90; 52/36.5, 36.6

[56] References Cited

U.S. PATENT DOCUMENTS

| | | | |
|---|---|---|---|
| 46,296 | 2/1865 | Colburn . | |
| 46,751 | 3/1865 | Bradflied . | |
| 394,144 | 12/1888 | Sword . | |
| 541,114 | 6/1895 | Nolan | 248/220.2 X |
| 1,755,453 | 4/1930 | Mullen | 248/297.3 X |
| 3,078,484 | 2/1963 | Briggs | 248/297.3 X |
| 3,313,509 | 4/1967 | Lockert | 248/223.3 X |
| 3,407,547 | 10/1968 | Doke | 52/36.6 |
| 4,094,415 | 6/1978 | Larson | 211/57.1 |
| 4,212,445 | 7/1980 | Hagen | 248/297.3 X |
| 4,450,655 | 5/1984 | Rosenthal | 52/36.4 |
| 4,581,859 | 4/1986 | Doke | 52/36.6 |
| 4,635,801 | 1/1987 | Oren | 211/70.6 |
| 4,678,151 | 7/1987 | Radek | 248/225.1 X |
| 4,805,784 | 2/1989 | Solheim et al. | 211/94 |
| 5,101,989 | 4/1992 | Jones | 211/94 |
| 5,109,993 | 5/1992 | Hutchinson | 211/87 |
| 5,110,080 | 5/1992 | Reiman | 248/225.1 |
| 5,138,803 | 8/1992 | Grossen | 52/36 |

FOREIGN PATENT DOCUMENTS

| | | | |
|---|---|---|---|
| 0048225 | 3/1982 | European Pat. Off. | 248/225.1 |

*Primary Examiner*—J. Franklin Foss

*Attorney, Agent, or Firm*—Plevy & Associates

[57] ABSTRACT

The display bracket assembly is essentially a two part apparatus having an insert plate member that is positioned within a vertical slot and a support member that extends into the vertical slot and couples to the insert plate member. The interconnection between the support member and the insert plate member retains the support member in a set position on the slatwall structure. In a preferred embodiment, latching elements and a locking projection extend from the support member. The latching elements are sized and oriented so that the latching elements will only pass into the vertical slot when the support member is held at a predetermined first orientation. After the latching elements are advanced into the vertical slot, the support member can be rotated into a second orientation from the first orientation. This manipulation prevents the latching elements from being removed from the vertical slot and causes the engagement means on the insert plate member to engage the latching element and lock the support member into a set position.

17 Claims, 4 Drawing Sheets

MOUNTING BRACKET ASSEMBLY FOR USE IN A SLATWALL CONSTRUCTION

FIELD OF THE INVENTION

The present invention relates to a mounting bracket assembly that engages the T-shaped slots in a slatwall construction. More particularly, the present invention relates to a two part mounting bracket apparatus where an insert plate is positioned within a slot on the slatwall and a separate bracket is joined to the insert plate through the aperture of the slot, thereby locking the bracket into a set position on the slatwall.

BACKGROUND OF THE INVENTION

Merchandise for sale to consumers comes in an almost infinite variety of sizes, shapes and packaging. A store, selling these goods, is therefore presented with the problem of displaying these goods for sale in a easy to reach and aesthetically pleasing manner. One method of displaying a variety of goods is by using a display rack where various brackets of differing sizes and shapes can be attached to the display rack to support the goods as desired. However, in the prior art, display racks typically only enable brackets to be mounted in a few distinct positions, thereby limiting the variety of positions in which goods can be displayed.

A common type of merchandise display includes a slatwall construction. In a slatwall construction, there are T-shaped grooves or "slots" into which various types of brackets can be mounted. The brackets are mounted to the slatwall construction at positions where merchandise is to be displayed. Since the slots in a slatwall construction typically extend across the entire length of the display, a merchant can position various brackets at any point along the length of each slot. In the prior art, brackets have been constructed to engage the slots of a slatwall construction in many different ways. One traditional means of attachment is by the use of a T-shaped protrusion that extends from each mounting bracket. The T-shaped protrusion, if properly aligned, fits into the aperture of a slot on the slatwall construction. The bracket is then rotated to engage the bracket with the slot. Such traditional means for attachment are exemplified in U.S. Pat. No. 4,805,784 to Solheim et al. entitled SLATWALL MOUNTING DEVICE and U.S. Pat. No. 46,296 to Colburn, entitled HAT & COAT RACK.

Another common means for attaching a bracket to a slatwall is with the use of a hook-shaped anchor that engages the slot in a slatwall to create a cantilever configuration. Such prior devices are exemplified by U.S. Pat. No. 5,138,803 to Grossen, entitled DISPLAY PANEL ASSEMBLY and U.S. Pat. No. 5,109,993 to Hutchinson, entitled MERCHANDISE DISPLAY SYSTEM AND MERCHANDISE HOLDER THEREFOR. Cantilever systems also exist where a bracket extends between two adjacent slots in a slatwall as exemplified by U.S. Pat. No. 5,101,989 to Jones, entitled DISPLAY SYSTEM.

A common feature of the above-referenced prior art is that all the brackets were designed to be mounted on a slatwall that has horizontal slots. As such, the brackets are free to move back and forth in the slots and the position of the brackets are unaffected by gravity. However, in some applications, it is often desirable to have a slatwall construction where the slots are vertical. In such an application, the brackets of the above-referenced patents cannot be used because those patents do not contain a locking mechanism that can be used to oppose gravity and hold the brackets in one set position. As a result, if inserted into vertical slots, gravity would pull the prior art brackets to the bottom most end of the slot.

In the prior art, mounting brackets have been developed that can be locked into a set position within the slot of a slatwall construction. Such prior art brackets are exemplified by U.S. Pat. No. 4,635,801 to Oren, entitled DEVICE FOR HOLDING AND SORTING ARTICLES. In the Oren patent, a mechanical fastener is used to join a clamping member inside the slot to a second clamping member outside the slot, thereby clamping the overall bracket to the slot. The attachment and adjustment of such a device requires the use of tools and the alignment of two small pieces across the slot. As a result, such a construction is difficult to install, difficult to adjust and is highly labor intensive. Furthermore, the clamping strength of the Oren patent limits the weight that it can support, thereby limiting the number and types of merchandise that can be displayed on any bracket.

It is, therefore, an object of the present invention to provide a mounting bracket apparatus that can be used in conjunction with a slatwall construction having vertical slots.

It is a further object of the present invention to provide such a mounting bracket that is easy to install, easy to adjust and capable of supporting a large amount of weight.

SUMMARY OF THE INVENTION

The present invention is a display bracket assembly used to support objects on a slatwall construction having generally vertical slots. The display bracket assembly is essentially a two part apparatus having a insert plate member that is positioned within a vertical slot and a support member that extends into the vertical slot and couples to the insert plate member. The interconnection between the support member and the insert plate member retains the support member in a set position on the slatwall structure. In a preferred embodiment, latching elements and a locking projection extend from the support member. The latching elements are sized and oriented so that the latching elements will only pass into the vertical slot when the support member is held at a predetermined first orientation. After the latching elements are advanced into the vertical slot, the support member can be rotated into a second orientation from the first orientation. This manipulation prevents the latching elements from being removed from the vertical slot and causes the engagement means on the insert plate member to engage the latching elements and lock the support member into a set position. As the support member is rotated from the first orientation to the second orientation, the locking projection present on the support member passes into the vertical slot. The presence of the locking projection within the vertical slot prevents the support member from inadvertently rotating back into the first orientation. As a result, the support member becomes affixed in a set position relative to the slatwall construction.

BRIEF DESCRIPTION OF THE DRAWINGS

For a better understanding of the present invention, reference is made to the following description of exemplary embodiment thereof, considered in conjunction with the accompanying drawings, in which.

DETAILED DESCRIPTION OF THE INVENTION

Figure 1:
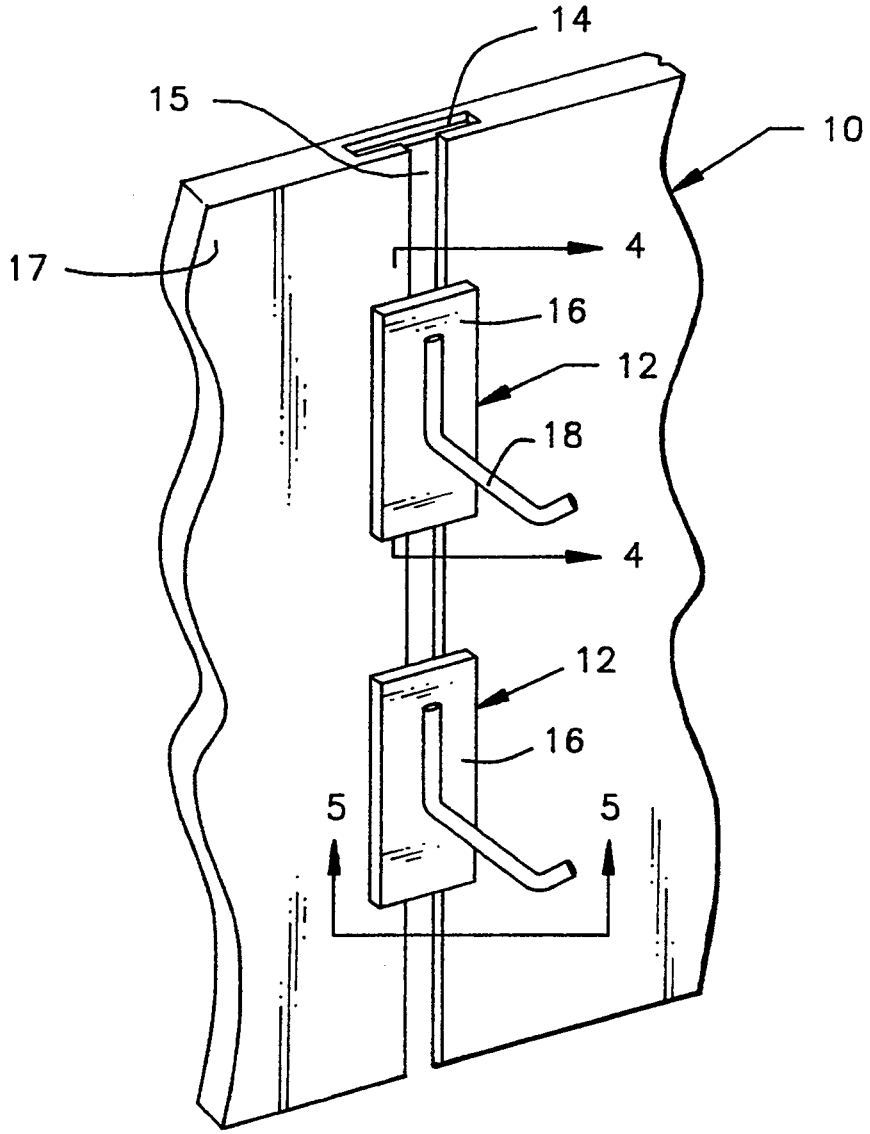
FIG. 1 shows a perspective view of one preferred embodiment of the present invention in conjunction with a vertical slatwall construction to facilitate consideration and discussion.

Referring to FIG. 1 a section of a slatwall construction 10 is shown in conjunction with an exemplary embodiment of the present invention mounting brackets 12. The slatwall construction 10 can be part of a wall display or any other surface upon which goods are to be placed. For instance, the slatwall construction may be part of a display in a retail store upon which consumer goods will be displayed to the public. Alternatively, the slatwall construction 10 may be a surface in a factory where shelving is to placed or tools hung. Despite its intended use, the slatwall construction 10 includes generally vertical slots 14, wherein generally vertical slots are defined as being slots that are closer to a vertical orientation then they are to a horizontal orientation. The slots 14 are generally T-shaped having a narrow aperture 15 that extends through the face surface 17 of the slatwall construction 10. Similar slatwall constructions, wherein the T-shaped slots are oriented in a horizontal direction, are widely used in the prior art.

The mounting brackets 12 that attach to the slatwall construction 10 include a baseplate 16 and a support element 18 that extends from the baseplate 16 away from the slatwall construction 10. The support element 18 can be any shape, wherein the shape of the support elements 18 depend entirely upon what goods they are intend to support. For example, the support elements could be hooks if they were intended to hold coats or the support elements 18 could be flat if they intended to hold shelving. In the shown embodiment, the support elements 18 are J-shaped so as to hold clothing on hangers or another similar consumer product.

Figure 2:
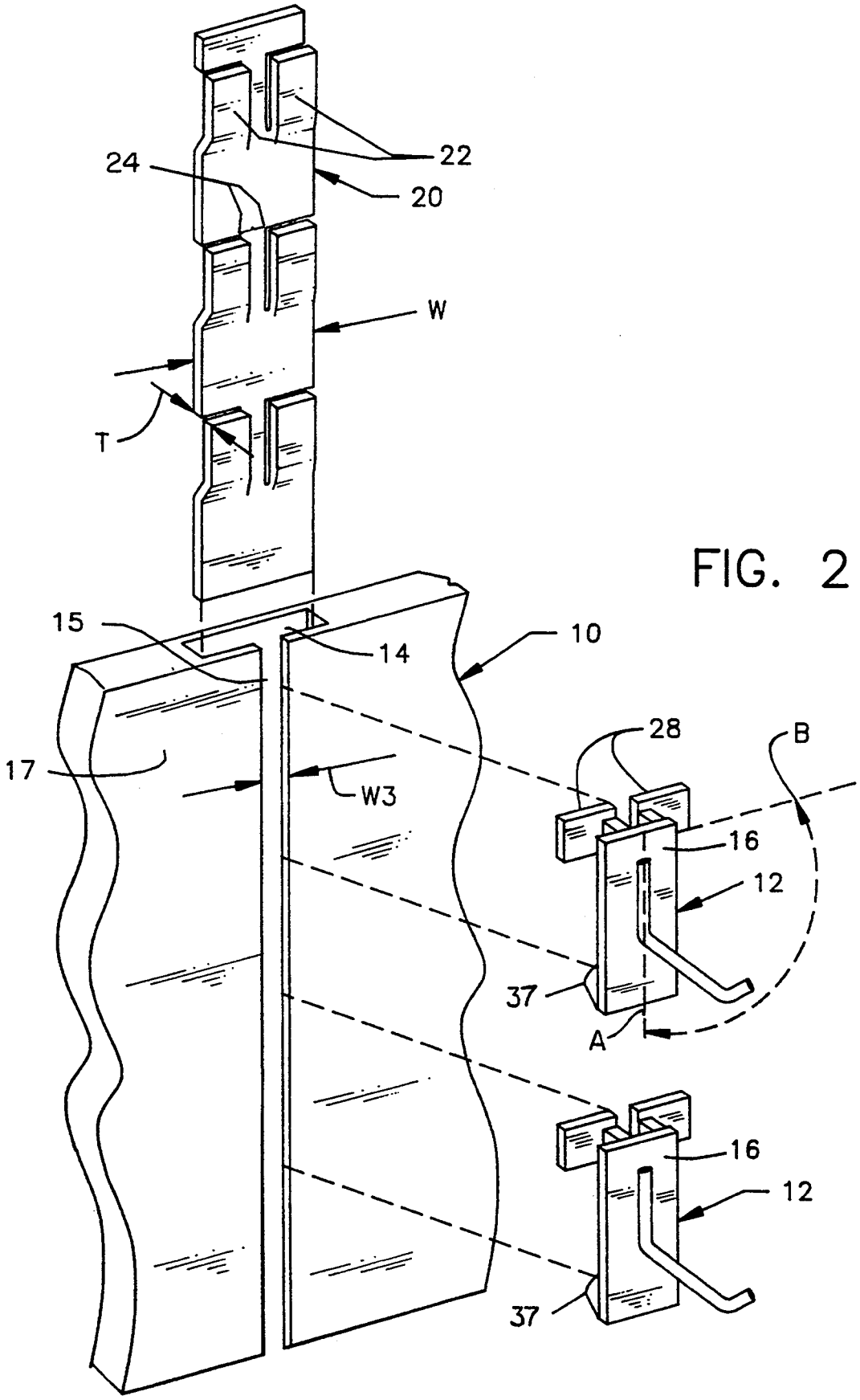
FIG. 2 shows a perspective exploded view of the embodiment shown in FIG. 1.

Referring to FIG. 2, it can be seen that in order to attach the mounting brackets 12 to the slatwall construction 10 a insert plate 20 is placed within the slot 14. The insert plate 20 contains a plurality of lock catches 22 that extend from the insert plate 20. Each lock catch 22 is essentially a U-shaped structure having one open end through which an appropriately shaped object can enter the lock catch. The lock catches 22 are disposed on the insert plate 20 in sets of two, wherein the two lock catches 22 are separated by a flat region 24. In the shown embodiment, the insert plate 20 is unistructurally formed, whereby the lock catches 22 are cut and formed from the otherwise planar structure of the insert plate 20. However, it will be understood that the lock catches 22 can be separated elements that are welded or otherwise joined to a planar backing to produce the same overall structure. Regardless to how it is formed, the insert plate 20 has a width W and thickness T that allows the insert plate 20 to be placed within the slot 14 on the slatwall construction 10. Since gravity will pull the insert plate 20 to the bottom of the slot 14, the length of the insert plate 20 is preferably equivalent to, or slightly less than, the length of the slot 14 in the slatwall construction 10. As such, the insert plate 20 will extend along the entire length of the slot 14 and will enable the attachment of the mounting brackets 12 as will later be explained. In an alternative embodiment, the width W and/or the thickness T of the insert plate 20 may be dimensioned to fit into the slot 14 with a slight interference fit. As a result, the insert plate 20 may be retained at one position within the slot 14 by the frictional forces of the interference fit.

Figure 3:
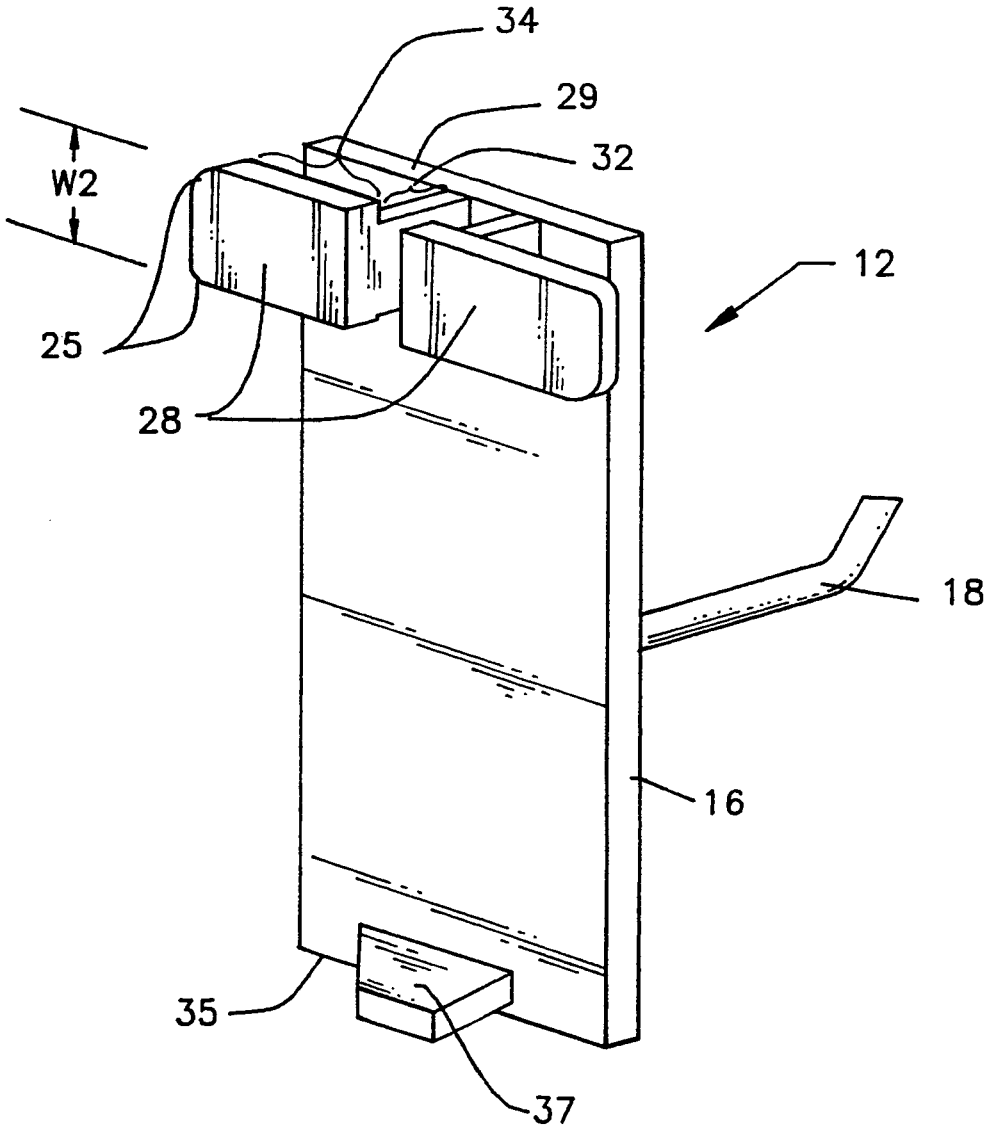
FIG. 3 shows a bottom perspective view of one preferred embodiment of a mounting bracket as used in the present invention.

Referring to FIG. 3 in conjunction with FIG. 2, it can be seen that the mounting brackets 12 have latching elements 28 extending from one side of the backplate 16, opposite the support element 18. The latching elements 28 extend from the backplate 16 at a point proximate the first end 29 of the backplate 16. In the shown embodiment, two latching elements 28 extend from backplate 16 forming an overall T-shaped extension. However, each latching element 28 is generally L-shaped having a short foot region 32 that extends in a plane perpendicular to the base plate 16 and a long region 34 that extends in a plane parallel to the baseplate 16. Each of the latching elements 28 has a width W2 that is smaller than the width W3 of the slot aperture 15 on the slatwall construction 10. As a result, if the mounting bracket 12 is manipulated so that the latching elements 28 align with the slot aperture 15, the latching elements 28 will pass into the slot aperture 15. In the shown embodiment, the short foot region 32 of each latching element 28 is not as wide as the width W2 of long region 34 section of the latching elements 28. This stepped construction prevents the short foot region 32 of each of the latching elements 28 from interfering with both the passage of the latching elements 28 into the slot aperture 15 and the rotational movement of the latching elements 28 once they are positioned within the slot on the slatwall construction 10. Similarly, the distal corners 25 of each of the latching elements 28 are rounded. This enhances the ability of the latching elements 28 to rotate within a slot without being inhibited by the confines of the slot. A seating lock 37 extends at a perpendicular from the second end 35 of the baseplate 16. Furthermore, for a purpose which will be later described, the seating lock 37 is sized to partially pass into the slot aperture 15 on the slatwall construction 10 as the mounting bracket 12 is joined to the slatwall construction 10.

Figure 4:
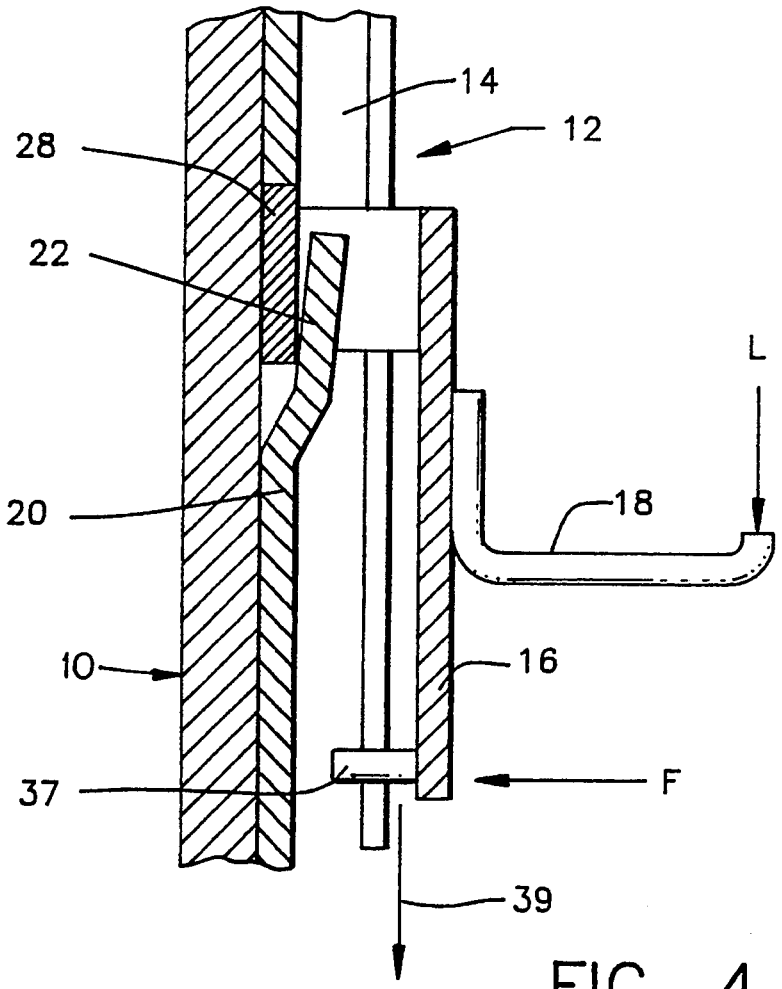
FIG. 4 shows a cross-sectional view of the embodiment shown in FIG. 1, viewed along section line 4—4.

To join a mounting bracket 12 to the slatwall construction 10, the insert plate 20 is positioned within a slot 14. Each mounting bracket 12 is rotated 90° from position A, shown in FIG. 2, to position B. At this orientation, the latching elements 28 that extend from the mounting bracket 12, are aligned with the slot aperture 15 in the slatwall construction 10. Once aligned, the latching elements 28 are passed through the slot aperture 15 into the slot 14. The mounting bracket 12 is then rotated 90° back from position B to original position A. Referring to FIG. 4, it can be seen that once the latching elements 28 are positioned within the slot 14, by moving the mounting bracket 12 downwardly in direction of arrow 37, the latching elements 28 will slide into the lock catches 22 that extend from the insert plate 20. The latching elements 28 are received by the locking catches 22, wherein the lock catches 22 prevent the further movement of the mounting bracket in the direction of arrow 39.

Figure 5:
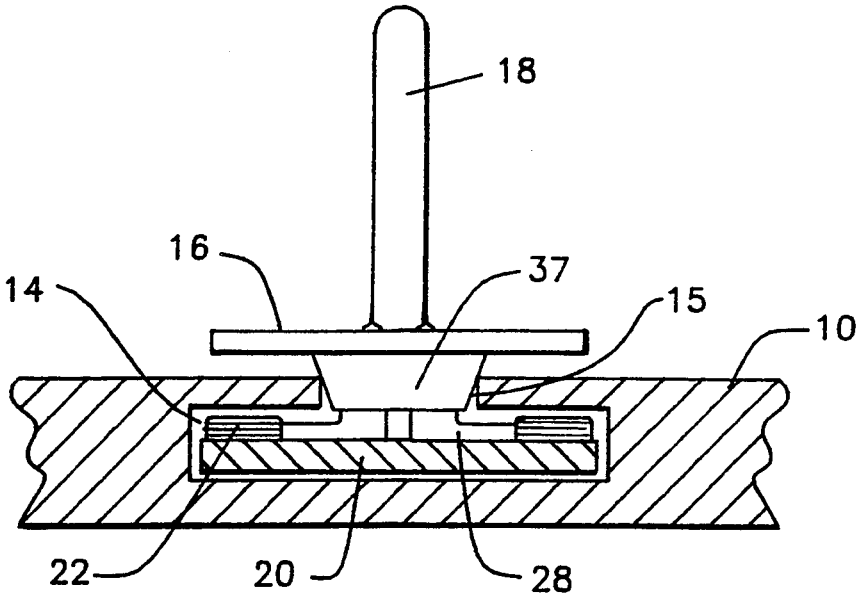
FIG. 5 shows a cross-sectional view of the embodiment shown in FIG. 1, viewed along section line 5—5.

Referring to FIG. 5 in conjunction with FIG. 4, it can be seen that as the mounting bracket 12 is attached to the slatwall construction 10, the seating lock 34 partially passes into the slot aperture 15. The presence of the seating lock 37 in the slot aperture 15 is advantageous in that it helps prevent the mounting bracket 12 from rotating with respect to the slatwall construction 10, thereby keeping the mounting bracket 12 properly aligned over the slot aperture 15. Furthermore, as a Load L is applied to the support element 18 by goods being hung on the mounting bracket 12, the force of the load L is pivotally transferred to the seating lock 37 as component force F. The component force F drives the seating lock 37 into the slot aperture 15. Since the seating lock 37 is wedge shaped, the seating lock 37 becomes impaled within the slot aperture 15. As a result, the components force F resulting from the load L on the support element 18 is transferred directly to the slot construction 10. The latching elements 28, therefore only experience a small amount of the Load L and the mounting bracket 12 is capable of support a large amount of weight without the fear of having the mounting bracket 12 becoming accidentally detached from the slatwall construction. As a result, the mounting bracket 12 is capable of supporting a large amount of weight with respect to the size of the mounting bracket.

To remove a mounting bracket 12 from the slatwall construction 10, the mounting bracket 12 is pushed upwardly in a direction opposite arrow 39. Such a movement causes the latching elements 28 that extend from the mounting bracket 12 to disengage from the lock catches 22 on the insert plate 20. Once disengaged, the mounting bracket 12 can be rotated so that the latching elements 28 align with the slot aperture 15 and the mounting bracket 12 can be removed or repositioned. The mounting bracket 12 can be repositioned to any point along the slot that corresponds to lock catches 22 on the insert plate 20. As such, if the lock catches 22 occur at two inch intervals, the mounting bracket 12 can be selectively adjusted at two inch intervals. Similarly, if the lock catches 22 are disposed at one foot intervals, the mounting brackets 12 could only be positioned along the slot at the positions every foot that correspond to the lock catches 22.

In the embodiment shown, the insert plate 20 is sized to be approximately the same length as the slots in the slatwall construction 10. As a result, the insert plate 20 rests upon the same base as does the slatwall construction 10 and its position is unaffected by gravity. In an alternate embodiment, the insert plate can be made to be much shorter than the length of the slots in the slatwall construction. In such an embodiment, the engagement of the support elements with the insert plate my create a clamping force on the slatwall, thereby holding both the insert plate and the support element at one set position on the slatwall construction.

It will be understood that the embodiment of the present invention described herein is merely exemplary and that a person skilled in the art may make many variations and modifications to the described embodiment utilizing different shapes, sizes, proportions and functionally equivalent components. More specifically, it should be understood that the shape of the above-described mounting brackets can be changed in any manner provided the mounting element has latching elements that engage an insert plate within a slot and retain the mounting element in place. All such equivalent components, variations and modifications are intended to be included within the scope of this invention as defined by the appended claims.

What is claimed is:

1. A display mounting assembly for use on a slatwall construction that contains at least one generally vertical slot therein, said display mounting assembly comprising:

at least one bracket positionable between a first and second orientation, said bracket having at least one latching element extending therefrom, wherein said at least one latching element is free to pass into and out of said generally vertical slot only when said bracket is at said first orientation;

a locking projection extending from said at least one bracket, said locking projection passing into said generally vertical slot as said support member is turned from said first orientation to said second orientation, thereby retaining said support member in said second orientation; and at least one insert plate member positionable within said generally vertical slot, said insert plate member having an engagement means thereon for engaging and retaining said at least one latching element in said generally vertical slot as said bracket is moved from said first orientation to said second orientation, thereby locking said bracket into a set position along said generally vertical slot.

2. The assembly according to claim 1, wherein said bracket includes a baseplate and an object support element, said at least one latching element extending from a first side of said base plate and said object support element extending from a side opposite said first side, whereby said object support element extends away from said slatwall construction when said bracket is engaged with said insert plate member at said second orientation.

3. The assembly according to claim 2, wherein said locking projection extends from said first side of said baseplate, said locking projection extending at least partially through said slot in said slatwall construction when said bracket is engaged with said insert plate member at said second orientation, thereby preventing said bracket from inadvertently moving laterally from said second orientation.

4. The assembly according to claim 1, wherein said at least one insert plate includes a plurality of engagement means periodically disposed at various locations thereon, whereby said at least one bracket can engage said at least one insert plate at any one of said various locations.

5. The assembly according to claim 3, wherein said locking projection contacts said slatwall construction when said bracket is engaged with said insert plate member at said second orientation, whereby said locking projection transfers a force applied to said object support element to said slatwall construction.

6. The assembly according to claim 5, wherein said locking projection is wedge shaped and is wedged into said slot in said slatwall construction as said force is applied to said slatwall construction.

7. A bracket assembly for engaging a generally vertical slot in a slatwall construction, comprising a support member shaped to support a desired object on said slatwall construction, said support element having at least one latching element extending therefrom capable of passing into said vertical slot when said support element is positioned in a first orientation;

a locking projection extending from said support member, said locking projection passing into said slot as said support member is turned from said first orientation to said second orientation, thereby retaining said support member in said second orientation; and engagement means disposed within said vertical slot at a plurality of locations, said engagement means engaging and retaining said at least one latching element in said vertical slot as said support member is moved from said first orientation to a second orientation, thereby attaching said support member to said slot at one of said plurality of locations.

8. The assembly according to claim 7, wherein said engagement means are disposed on an insert plate member that is positionable within said vertical slot.

9. The assembly according to claim 7, where said engagement means include a plurality of receptacles, each said receptacle having one open end through which said at least one latching element can pass, wherein the receptacle retains said at least one latching element at one of said plurality of locations.

10. The assembly according to claim 7, wherein said support member aligns over said slot in said slatwall construction as said support member engages said engagement means at said second orientation.

11. The assembly according to claim 7, wherein said at least one latching element is positioned vertically with said slot when said support member is at said first orientation and said at least one latching element is positioned horizontally with respect to said vertical slot when said support member is at said second orientation, thereby preventing the passage of said at least one latching element through said slot.

12. A method of attaching a bracket assembly to a slatwall construction that contains generally vertical slots, comprising the steps of:

providing an insert member having at least one locking device thereon;

inserting said insert member into a vertical slot on said slatwall construction;

providing a support member having at least one latching element extending therefrom capable of extending into said vertical slot when said support member is moved to a first orientation;

inserting said at least one latching element of said support member into said vertical slot by moving said support element to said first orientation and advancing said at least one latching element into said vertical slot;

moving said support member from said first orientation to a second orientation wherein said at least one latching element is engaged by said at least one locking device on said insert member, thereby retaining said support member in a set orientation relative said vertical slot; and locking said support member into said second orientation.

13. The method according to claim 12, wherein said step of locking said support member into said second orientation includes providing a locking projection that extends from said support member at a position that enables said locking projection to extend into said vertical slot when said support member is at said second orientation.

14. The method according to claim 12, wherein said step of moving said support member from a first orientation to a second orientation includes rotating said at least one latching element in said vertical slot and advancing said at least one latching element into said at least one locking device on said insert member.

15. The method according to claim 14, wherein said at least one locking device includes receptacles having one open end through which said at least one latching element can be advanced, whereby said receptacles prevent the advancement of said at least one latching element in one direction and permit the retraction of said at least one latching element in the opposite direction.

16. The method according to claim 13, wherein said locking projection contacts said slatwall construction when said support member is engaged with said insert member at said second orientation, whereby said locking projection transfers a force applied to said support member to said slatwall construction.

17. The method according to claim 16, wherein said locking projection os wedge shaped and is wedged into said slot in said slotwall construction as said force is applied to said slatwall construction.

* * * * *